US010463206B2

(12) United States Patent
Edwards

(10) Patent No.: US 10,463,206 B2
(45) Date of Patent: Nov. 5, 2019

(54) PAPER ROLL SUPPORT ASSEMBLY

(71) Applicant: Liberty Hardware Mfg. Corp., Winston-Salem, NC (US)

(72) Inventor: Neil Thomas Edwards, Kernersville, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 184 days.

(21) Appl. No.: 15/652,362

(22) Filed: Jul. 18, 2017

(65) Prior Publication Data

US 2019/0021558 A1 Jan. 24, 2019

(51) Int. Cl.
*A47K 10/40* (2006.01)

(52) U.S. Cl.
CPC ..... *A47K 10/40* (2013.01)

(58) Field of Classification Search
CPC ..... A47K 10/40; A47K 10/405; B65H 16/06; B65H 19/126
See application file for complete search history.

(56) References Cited

U.S. PATENT DOCUMENTS 2,948,486 A * 8/1960 Epeneter ..... A47K 10/38 242/596.4
2,978,197 A * 4/1961 Anderson ..... A47K 10/38 242/596.4
4,043,519 A * 8/1977 Suzuki ..... A47K 10/38 242/596.4
5,782,428 A * 7/1998 Chabot ..... A47K 10/38 242/596.3
5,868,347 A * 2/1999 Paul ..... A47K 10/40 242/596.4
6,189,828 B1 * 2/2001 Reilly ..... A47K 10/40 242/596.4
6,286,781 B1 9/2001 Lai
6,328,253 B1 * 12/2001 Paul ..... A47K 10/40 242/596.3
8,616,491 B2 * 12/2013 Smith ..... A47K 10/40 242/596.4
2003/0189126 A1 10/2003 Hale
2008/0283658 A1 11/2008 Reilly
2012/0091251 A1 * 4/2012 Smith ..... A47K 10/40 242/596.4

* cited by examiner

*Primary Examiner* — William A. Rivera
(74) *Attorney, Agent, or Firm* — Brooks Kushman P.C.; Lora Graentzdoerffer

(57) ABSTRACT

A paper roll assembly is provided with first and second plates and first and second arm assemblies. Each of the first and second plates defines a through-hole and includes two plate tabs spaced from one another and located on a plate inner surface. Each of the first and second arm assemblies is arranged with one of the first and second plates for rotation independent of the plate. Each arm assembly includes an arm secured to an internal shaft extending through the through-hole. Each internal shaft includes a first shaft tab and a second shaft tab extending from the internal shaft. One of the internal shafts is arranged with one of the plates so rotation of the internal shaft is constrained to facilitate mount or removal of the paper roll by contact between one of the two plate tabs and one of the first shaft tab and the second shaft tab.

20 Claims, 5 Drawing Sheets

PAPER ROLL SUPPORT ASSEMBLY

TECHNICAL FIELD

Various embodiments relate to paper roll support assemblies and components to facilitate mounting and removal of paper rolls to the support assembly.

BACKGROUND

Paper roll holders often require a user to disassemble a portion of the paper roll holder to replace the paper roll. For example, a removable bar may extend between two mounts to support the paper roll. The bar may have a telescoping feature so that a user may disengage the bar from the mounts, place a paper new roll upon the bar, and engage the bar to the mounts with the new paper roll.

Other examples of paper roll holders have various pivot assemblies to assist in replacing paper rolls. These pivot assemblies, however, may not include robust components to facilitate easy replacement of paper rolls.

SUMMARY

According to at least one embodiment, a paper roll assembly is provided with first and second plates and first and second arm assemblies. Each of the first and second plates defines a through-hole and includes two plate tabs spaced from one another and located adjacent the through-hole on a plate inner surface. Each of the first and second arm assemblies is arranged with one of the first and second plates for rotation independent of the plate. Each arm assembly includes an arm secured to an internal shaft extending through the through-hole. Each internal shaft includes a first shaft tab and a second shaft tab extending from the internal shaft. One of the internal shafts is arranged with one of the plates so that rotation of the internal shaft is constrained to facilitate mount or removal of the paper roll by contact between one of the two plate tabs and one of the first shaft tab and the second shaft tab. A spring may be disposed upon one of the internal shafts to bias rotation of one of the internal shafts toward an at-rest position. The spring may include a first spring extension and a second spring extension. The spring may be arranged within a cavity defined by one of the first and second plates such that the first spring extension contacts one of the two plate tabs when the internal shaft is in the at-rest position and the second spring extension contacts another one of the two plate tabs when the internal shaft is in a roll release position. Each internal shaft may further include an inner surface defining a cavity extending a length of the internal shaft. Each inner surface may further define a ledge sized for a head of a fastener to rest upon when the fastener extends through the cavity and is secured to one of the first and second arm assemblies. Each of the first and second arm assemblies may include a first portion to secure to a fastener and extend along a first axis and a second portion to mount a paper roll thereupon and extend along a second axis oriented perpendicular to the first axis. An anchor assembly may be secured to a surface and include an upper edge sized for a lip of one of the first and second plates to rest upon. Each of the first and second plates may be sized to conceal a respective anchor assembly mounted to a support surface.

According to at least another embodiment, a wall mount paper roll assembly is provided with first and second housings, first and second arm assemblies, first and second internal shafts, and a fastener. Each of the first and second housings includes a through-hole and two or more housing tabs spaced radially about the through-hole at approximately ninety-degree intervals relative to a center of the through-hole. The first and second arm assemblies are for supporting a paper roll. Each of the first and second internal shafts includes a shaft cavity extending a length of a corresponding internal shaft and a shaft ledge. The fastener is for extending through one of the first and second internal shafts and one of the first and second housings and includes a head. Each of the shaft ledges is sized for a portion of the head to rest thereupon and one end of the fastener is for securing to one of the first and second arm assemblies so that one of the first and second arm assemblies rotates with one of the internal shafts independent of either of the first and second housings and so that the paper roll may be mounted or removed. Each of the first and second housings may define a cavity about the two or more housing tabs sized so the two or more housing tabs do not contact a supporting surface. Each of the first and second internal shafts may define a diameter sized to position each of the first and second internal shafts about a cylindrical portion of one of the first and second arm assemblies. Each of the first and second internal shafts may include a pair of shaft tabs sized for contact with the two or more housing tabs to constrain rotation of each of the first and second internal shafts. The assembly may further include a pair of springs. Each spring may be disposed upon one of the first and second internal shafts to bias rotation of the one of the first and second internal shafts toward an at-rest position. Each of the pair of springs may include a first spring extension and a second spring extension. Each of the springs may be arranged within a cavity defined by one of the first and second housings such that the first spring extension contacts one of the two or more housing tabs when one of the first and second internal shafts is in the at-rest position and the second spring extension may contact another one of the two or more housing tabs when one of the first and second internal shafts is in a paper roll release position. Each of the first and second housings may further include a lip sized for resting upon an edge of an anchor assembly mounted to a surface. Each of the first and second housings may be sized to conceal the anchor assembly retaining the first and second housings upon a surface.

According to at least another embodiment, a paper roll assembly is provided with a housing, an arm, an internal shaft, a pair of shaft tabs, and a fastener. The housing defines a housing through-hole. The internal shaft extends through the housing through-hole and defines a shaft through-hole. The pair of shaft tabs is arranged with the housing to constrain rotation of the internal shaft. The fastener is for extending through the housing through-hole and the shaft through-hole and includes a fastener end for securing to the arm so the arm and internal shaft rotate with one another. The housing and the arm are arranged with one another for mounting upon a surface so that a paper roll may rest upon the arm between the housing and an external obstacle. The housing may further define a cavity about two or more housing tabs located adjacent the housing through-hole. The cavity may be sized so the two or more housing tabs do not contact a surface supporting the housing. The arm may be arranged with the housing so that a portion of the arm for supporting the paper roll and the internal shaft may rotate between an at-rest position to a roll release position approximately ninety degrees from the at-rest position. A spring may be disposed upon the internal shaft to bias rotation of the internal shaft toward an at-rest position and include first and second spring extensions arranged with a cavity defined by the housing such that the first spring extension contacts a first tab of the housing when the internal shaft is in an at-rest position and the second spring extension contacts a second tab of the housing when the internal shaft is in a paper roll release position. The housing may further include a lip sized for resting upon an edge of an anchor assembly mounted to a surface. The housing may be sized to conceal the anchor assembly when mounted to the surface.

DETAILED DESCRIPTION

As required, detailed embodiments of the present invention are disclosed herein; however, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present embodiments.

Figure 1:
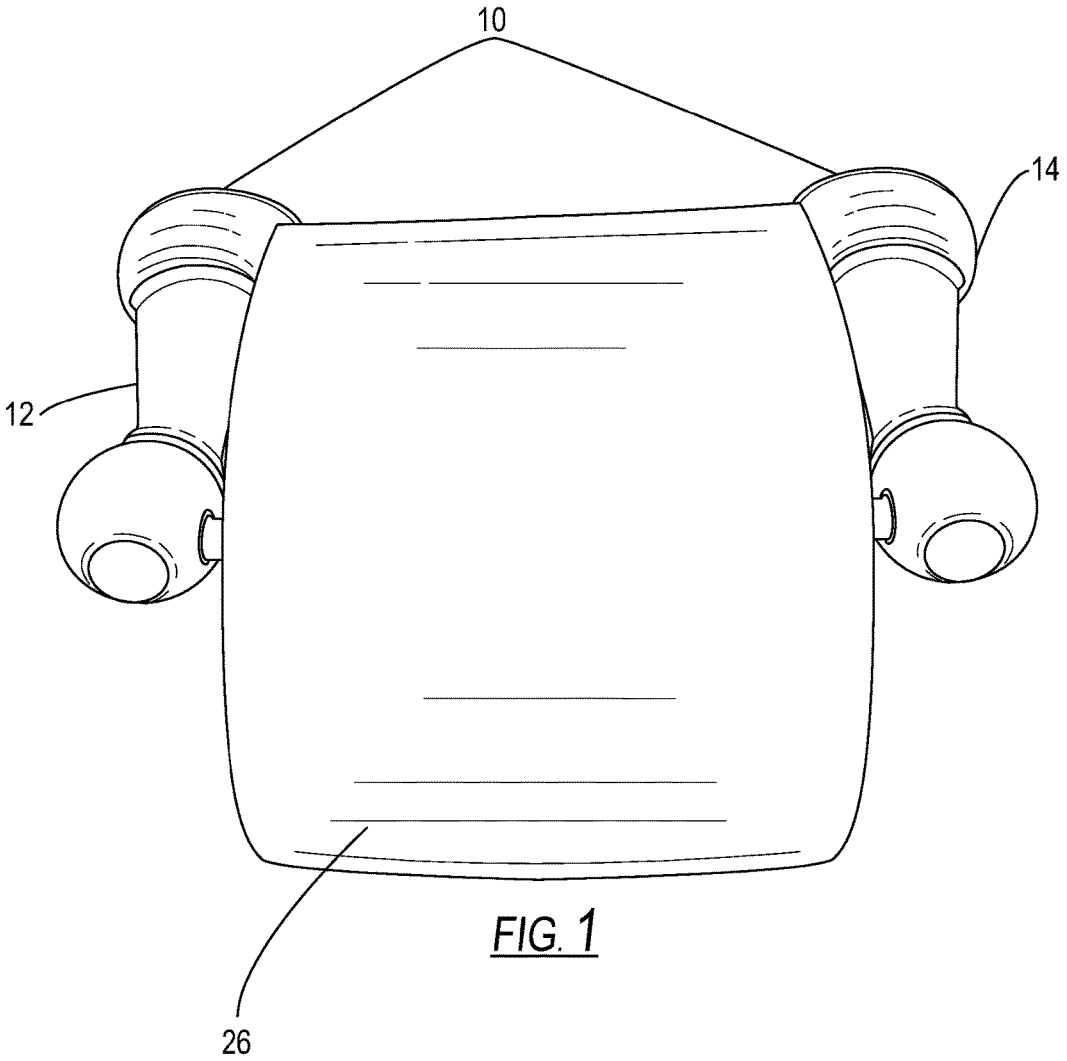
FIG. 1 is a front perspective view of an example of a paper roll assembly with a toilet paper roll mounted thereupon and according to an embodiment.

FIG. 1 shows an example of a paper roll assembly, generally referred to as a paper roll assembly 10 herein. The paper roll assembly 10 may include a first arm assembly 12 and a second arm assembly 14. The first arm assembly 12 and the second arm assembly 14 may be spaced from one another to receive a paper roll therebetween. For example, the paper roll assembly 10 may be sized for mounting a toilet paper roll 26 thereupon. Alternatively, the paper roll assembly 10 may be sized for mounting other types of paper rolls, such as a paper towel roll. In another example in which space is limited upon a surface for a mount zone, the paper roll assembly 10 may include only one arm assembly. Components of the paper roll assembly 10 may be stylized in various patterns and shapes. The first arm assembly 12 and the second arm assembly 14 may operate with one another to facilitate mount and removal of the toilet paper roll 26.

Figure 2:
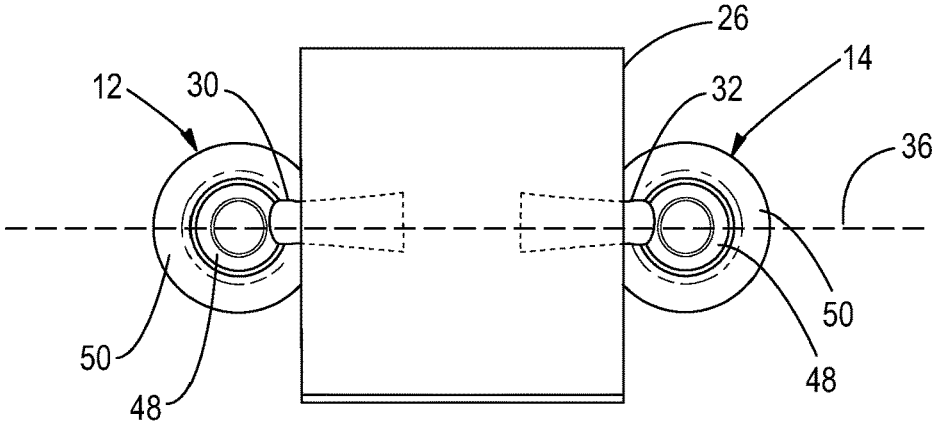
FIG. 2 is a front view is a front view of the example of the paper roll assembly of FIG. 1 showing first and second arms in a first configuration.
Figure 3:
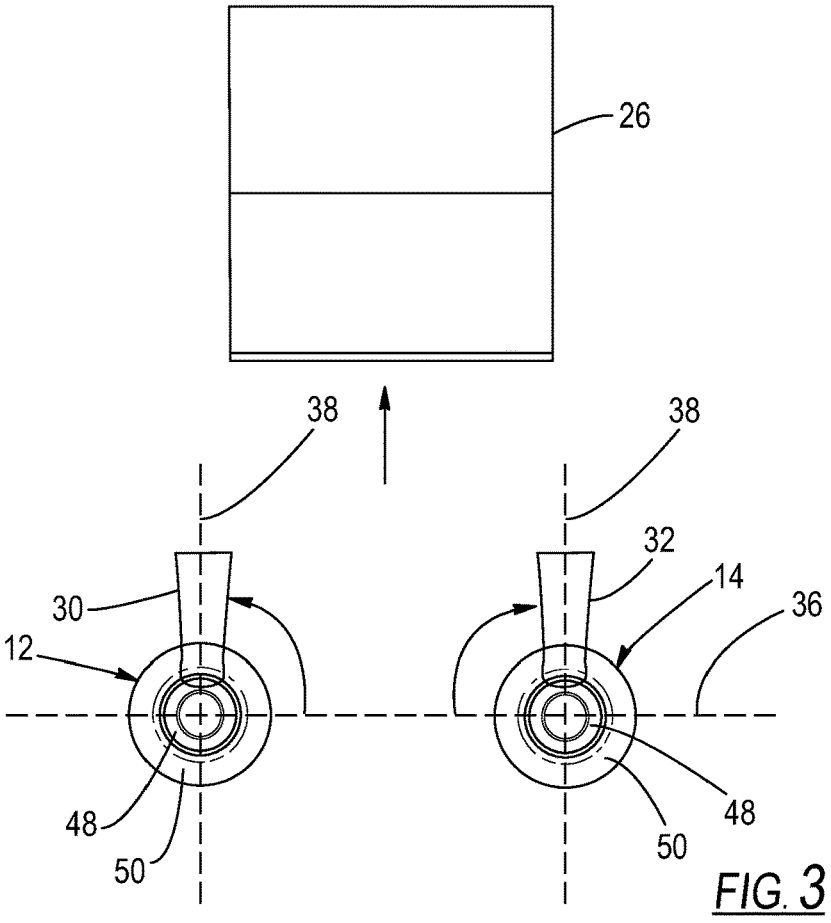
FIG. 3 is a front view of the example of the paper roll assembly of FIG. 1 showing the first and second arms in a second configuration.

For example, FIGS. 2 and 3 show two configurations of the arm assemblies. Each of the first arm assembly 12 and the second arm assembly 14 may rotate to mount and remove the toilet paper roll 26. In FIG. 2, a first arm 30 of the first arm assembly 12 and a second arm 32 of the second arm assembly 14 are shown in a first configuration and aligned with a first axis 36. In FIG. 3, the first arm 30 and the second arm 32 are shown in a second configuration and each aligned with a second axis 38. The first axis 36 is oriented perpendicular to each of the second axes 38. In this example, each of the first arm 30 and the second arm 32 may rotate from zero to ninety degrees relative to the first axis 36.

Figure 4:
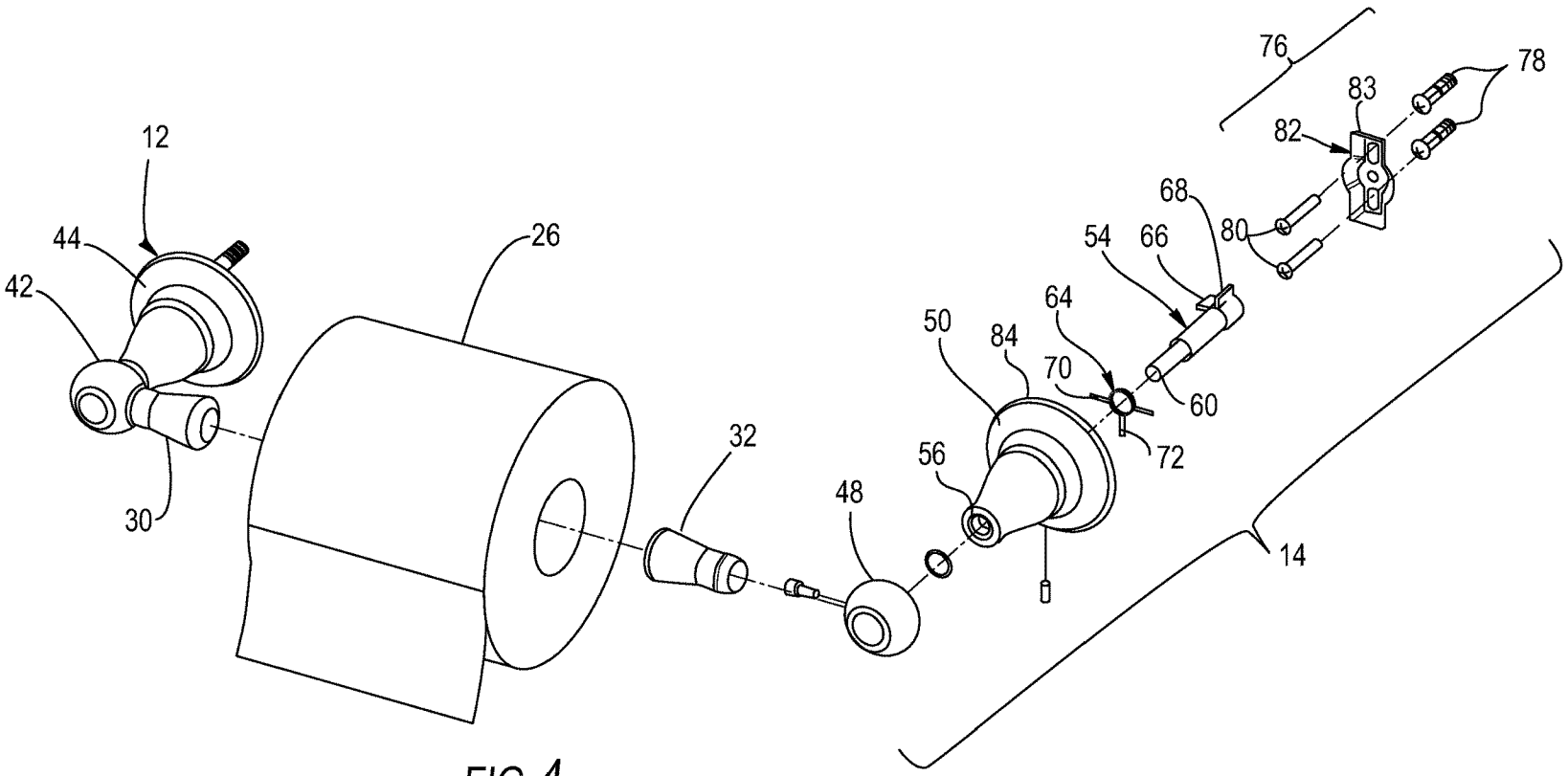
FIG. 4 is an exploded view of the example of the paper roll assembly of FIG. 1.

FIG. 4 is an exploded view of the paper roll assembly 10 illustrating components thereof. The first arm assembly 12 may include a first bulb member 42 secured to the first arm 30 so that the first bulb member 42 and the first arm 30 rotate with one another. The first bulb member 42 may be attached to a first wall mount 44 for rotation. The first wall mount 44 may include components for securement to a wall or other surface.

The second arm assembly 14 may include a second bulb member 48 secured to the second arm 32 so that the second bulb member 48 and the second arm 32 rotate with one another. The second bulb member 48 may be attached to a second wall mount 50 for rotation. For example, an internal shaft 54 may extend through an opening 56 defined by the second wall mount 50. A first end 60 of the internal shaft 54 may be secured to the second bulb member 48 so that the internal shaft 54 rotates with the second arm 32 and the second bulb member 48 while the second wall mount 50 is secured to a wall or other surface.

A spring 64 may operate with the second wall mount 50, a first shaft tab 66 of the internal shaft 54, and a second shaft tab 68 of the internal shaft 54 to constrain rotation of the second arm 32. The second wall mount 50 may include constraint tabs (further described below) within a cavity defined by the second wall mount 50. The constraint tabs may be may be radially spaced about the opening 56. A first spring extension 70 and a second spring extension 72 may operate with the constraint tabs and the shaft tabs such that the second arm 32 may rotate from zero to ninety degrees relative to the first axis 36. For example, rotation of the second arm 32 directs rotation of the internal shaft 54. The constraint tabs are arranged within the cavity of the second wall mount 50 to contact the first shaft tab 66 at a zero position and the second shaft tab 68 at a ninety-degree position. The spring 64 is arranged with the internal shaft 54 to return the internal shaft 54 from the ninety-degree position to the zero position.

The second arm assembly 14 may include an anchor assembly, such as an anchor assembly 76, to secure the second wall mount 50 to a wall or surface. The anchor assembly 76 may include a pair of wall anchors 78, a pair of fasteners 80, and a plate 82. Each of the wall anchors 78 may be mounted to a wall and each of the pair of fasteners 80 may be secured to one of the wall anchors 78 through openings of the plate 82 to secure the plate 82 to the wall. The plate 82 may include an upper portion 83 for a lip 84 of the second wall mount 50 to rest thereupon. The anchor assembly 76 and the second wall mount 50 may be arranged with one another so that the internal shaft 54 may rotate independent of the second wall mount 50.

It is contemplated that the components of the first arm assembly 12 and the second arm assembly 14 may have various shapes which differ from the examples shown in FIGS. 1 through 4. It is to be understood that the first arm assembly 12 may include components similar to the second arm assembly 14.

Figure 5:
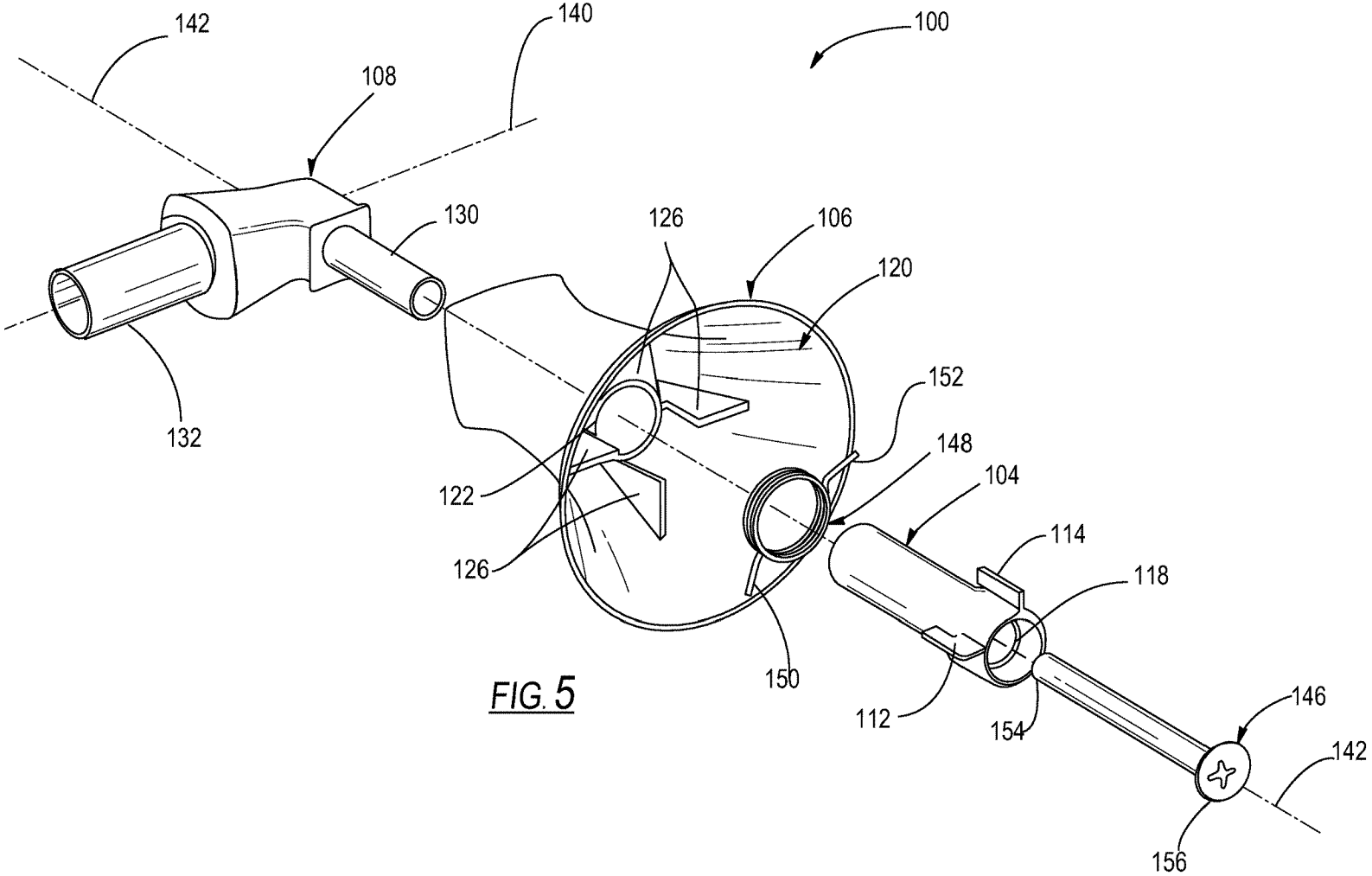
FIG. 5 is an exploded view of a portion of another paper roll assembly according to another embodiment.

FIG. 5 shows another example of a portion of a paper roll assembly, generally referred to as a paper roll assembly 100 herein. The paper roll assembly 100 may include an internal shaft 104, a housing 106, and an arm 108. The internal shaft 104 may be cylinder-shaped and include a first shaft tab 112 and a second shaft tab 114. An inner surface of the internal shaft 104 may define a cavity extending a length of the internal shaft 104 and a ledge 118.

The housing 106 may define a cavity 120 open to a through-hole 122. An inner surface of the housing 106 may define housing tabs 126. The housing tabs 126 may be radially spaced from one another about and edge of the through-hole 122. For example, each of the housing tabs 136 may be radially spaced from one another at ninety degree intervals about a center of the through-hole 122.

The arm 108 may include a first portion 130 and a second portion 132. The first portion 130 and the second portion 132 may be oriented perpendicular to one another. For example, a first axis 140 may extend through a center of the first portion 130 and a second axis 142 oriented perpendicular to the first axis 140 may extend through a center of the second portion 132. The first axis 140 may also extend through a center of the internal shaft 104 and a center of the housing 106.

A fastener 146 may rotatably secure the housing 106 and the arm 108 to one another. For example, the fastener 146 may extend through the internal shaft 104, through a spring 148, and through the housing 106. The spring 148 may be secured to the internal shaft 104 and includes a first spring extension 150 and a second spring extension 152. Each of the spring extensions extends from the spring to bias movement of the internal shaft 104 and the arm 108. For example, the spring 148 may be arranged with the internal shaft 104 and the housing tabs 126 to bias rotation of the arm 108 to return to an at-rest position. A first end 154 of the fastener 146 is secured to the first portion 130 of the arm 108. A head 156 of the fastener 146 is sized to rest upon the ledge 118 of the internal shaft 104 so that the internal shaft 104 and the arm 108 may rotate independent of the housing 106.

Figure 6:
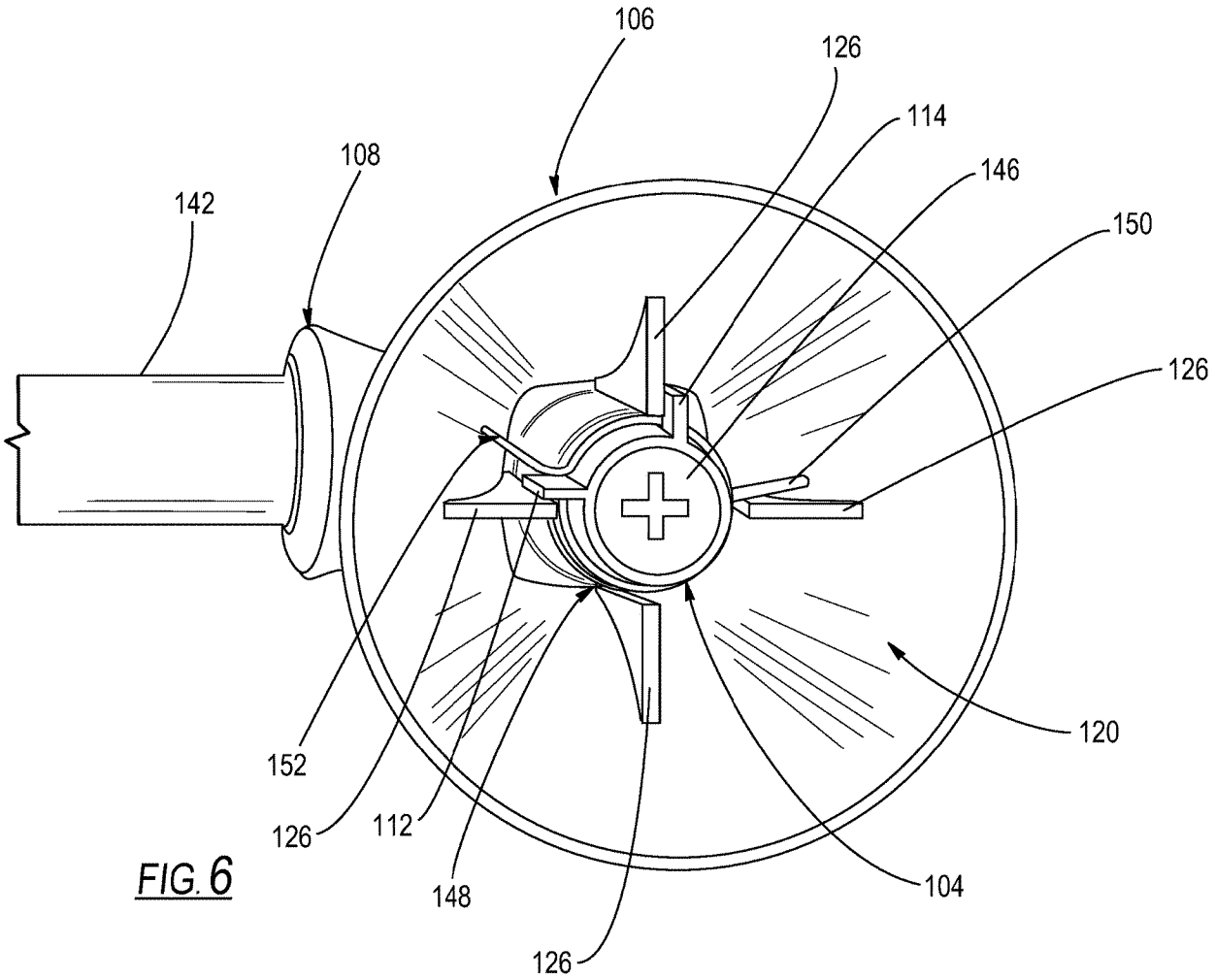
FIG. 6 is a rear perspective view of a portion of the paper roll assembly of FIG. 5.

FIG. 6 shows an assembled portion of the paper roll assembly 100. Rotation of the internal shaft 104 is constrained by the housing tabs 126. For example, the first shaft tab 112 and the second shaft tab 114 are arranged upon the internal shaft 104 for contact with one or more of the housing tabs 126. The internal shaft 104 is prevented from continued rotation when the first shaft tab 112 or the second shaft tab 114 contacts one of the housing tabs 126. In one example, the internal shaft 104 and the arm 108 may rotate between the at-rest position to a roll release position substantially ninety-degrees from the at-rest position. In the roll release position, the arm 108 is oriented such that a paper roll mounted to the arm 108 may be removed.

The first spring extension 150 and the second spring extension 152 are each arranged relative to the internal shaft 104 to bias rotation of the internal shaft 104 to return to the at-rest position. For example, the first spring extension 150 may remain in contact with one of the housing tabs 126 throughout rotation of the internal shaft 104. The second spring extension 152 may contact one of the housing tabs 126 when the internal shaft 104 is rotated to the roll release position.

An anchor assembly (not shown) may secure the paper roll assembly 100 to a support surface. For example, the anchor assembly may include wall anchors, a plate, and fasteners for extending through the plate and into the wall anchors. The plate may have an edge for a lip of the housing 106 to rest upon. The housing 106 and the anchor assembly may be arranged with one another so the anchor assembly is concealed when the housing is mounted thereto.

While various embodiments are described above, it is not intended that these embodiments describe all possible forms of the invention. Rather, the words used in the specification are words of description rather than limitation, and it is understood that various changes may be made without departing from the spirit and scope of the present disclosure. Additionally, the features of various implementing embodiments may be combined to form further embodiments of the invention.

What is claimed is:

1. A paper roll assembly comprising:

first and second plates, each plate defining a through-hole and comprising two constraint tabs spaced from one another and located adjacent the through-hole on a plate inner surface; and first and second arm assemblies for supporting a paper roll, each arm assembly arranged with one of the first and second plates for rotation independent of the plate, and each arm assembly including an arm secured to an internal shaft extending through the through-hole, wherein each internal shaft includes a first shaft tab and a second shaft tab extending from the internal shaft, and wherein one of the internal shafts is arranged with one of the plates so that rotation of the internal shaft is constrained to facilitate mount or removal of the paper roll by contact between one of the two constraint tabs and one of the first shaft tab and the second shaft tab.

2. The assembly of claim 1 further comprising a spring disposed upon one of the internal shafts to bias rotation of one of the internal shafts toward an at-rest position.

3. The assembly of claim 2, wherein the spring further comprises a first spring extension and a second spring extension, and wherein the spring is arranged within a cavity defined by one of the first and second plates such that the first spring extension contacts one of the two constraint tabs when the internal shaft is in the at-rest position and the second spring extension contacts another one of the two constraint tabs when the internal shaft is in a roll release position.

4. The assembly of claim 1, wherein each internal shaft further includes an inner surface defining a cavity extending a length of the internal shaft, and wherein each inner surface further defines a ledge sized for a head of a fastener to rest upon when the fastener extends through the cavity and is secured to one of the first and second arm assemblies.

5. The assembly of claim 1, wherein each of the first and second arm assemblies includes a first portion to secure to a fastener and extending along a first axis and a second portion to mount a paper roll thereupon and extending along a second axis oriented perpendicular to the first axis.

6. The assembly of claim 1 further comprising an anchor assembly for securing to a surface and including an upper edge sized for a lip of one of the first and second plates to rest upon.

7. The assembly of claim 6, wherein each of the first and second plates are sized to conceal a respective anchor assembly mounted to a support surface.

8. A wall mount paper roll assembly comprising:

first and second housings, each housing including a through-hole and two or more housing tabs spaced radially about the through-hole at approximately ninety-degree intervals relative to a center of the through-hole;

first and second arm assemblies for supporting a paper roll;

first and second internal shafts, each defining a shaft cavity extending a length of a corresponding internal shaft and a shaft ledge; and a fastener for extending through one of the first and second internal shafts and one of the first and second housings and including a head, wherein each of the shaft ledges is sized for a portion of the head to rest thereupon and one end of the fastener is for securing to one of the first and second arm assemblies so that one of the first and second arm assemblies rotates with one of the internal shafts independent of either of the first and second housings and so that the paper roll may be mounted or removed.

9. The assembly of claim 8, wherein each of the first and second housings defines a cavity about the two or more housing tabs sized so the two or more housing tabs do not contact a supporting surface.

10. The assembly of claim 8, wherein each of the first and second internal shafts defines a diameter sized to position each of the first and second internal shafts about a cylindrical portion of one of the first and second arm assemblies, and wherein each of the first and second internal shafts comprises a pair of shaft tabs sized for contact with the two or more housing tabs to constrain rotation of each of the first and second internal shafts.

11. The assembly of claim 8 further comprising a pair of springs, each spring disposed upon one of the first and second internal shafts to bias rotation of the one of the first and second internal shafts toward an at-rest position.

12. The assembly of claim 11 wherein each of the pair of springs includes a first spring extension and a second spring extension, and wherein each of the springs is arranged within a cavity defined by one of the first and second housings such that the first spring extension contacts one of the two or more housing tabs when one of the first and second internal shafts is in the at-rest position and the second spring extension contacts another one of the two or more housing tabs when one of the first and second internal shafts is in a paper roll release position.

13. The assembly of claim 8, wherein each of the first and second housings further includes a lip sized for resting upon an edge of an anchor assembly mounted to a surface.

14. The assembly of claim 8, wherein each of the first and second housings is sized to conceal an anchor assembly retaining the first and second housings upon a surface.

15. A paper roll assembly comprising:

a housing defining a housing through-hole;

an arm;

an internal shaft for extending through the housing through-hole and defining a shaft through-hole;

a pair of shaft tabs arranged with the housing to constrain rotation of the internal shaft; and a fastener for extending through the housing through-hole and the shaft through-hole and including a fastener end for securing to the arm so the arm and internal shaft rotate with one another, wherein the housing and the arm are arranged with one another for mounting upon a surface so that a paper roll may rest upon the arm.

16. The assembly of claim 15, wherein the housing further defines a cavity about two or more housing tabs located adjacent the housing through-hole, and wherein the cavity is sized so the two or more housing tabs do not contact a surface supporting the housing.

17. The assembly of claim 15, wherein the arm is arranged with the housing so that a portion of the arm for supporting the paper roll and the internal shaft may rotate between an at-rest position to a roll release position approximately ninety degrees from the at-rest position.

18. The assembly of claim 15 further comprising a spring disposed upon the internal shaft to bias rotation of the internal shaft toward an at-rest position and including first and second spring extensions arranged with a cavity defined by the housing such that the first spring extension contacts a first tab of the housing when the internal shaft is in an at-rest position and the second spring extension contacts a second tab of the housing when the internal shaft is in a paper roll release position.

19. The assembly of claim 15, wherein the housing further comprises a lip sized for resting upon an edge of an anchor assembly mounted to a surface.

20. The assembly of claim 19, wherein the housing is sized to conceal the anchor assembly when mounted to the surface.

* * * * *